US011873648B2

(12) United States Patent
Carlson et al.

(10) Patent No.: US 11,873,648 B2
(45) Date of Patent: Jan. 16, 2024

(54) DECK CLIP

(71) Applicant: OMG, Inc., Agawam, MA (US)

(72) Inventors: Logan Carlson, Wilbraham, MA (US); Mitchell T. Kraucunas, Enfield, CT (US); Frederick A. Enko, Westfield, MA (US); Anthony DiSanto, Holyoke, MA (US); Timothy F. Gillis, Florence, MA (US); Peter M. Barenski, Stockbridge, MA (US); Mark J. Guthrie, West Springfield, MA (US)

(73) Assignee: OMG, Inc., Agawam, MA (US)

( * ) Notice: Subject to any disclaimer, the term of this patent is extended or adjusted under 35 U.S.C. 154(b) by 0 days.

(21) Appl. No.: 17/213,389

(22) Filed: Mar. 26, 2021

(65) Prior Publication Data

US 2021/0301543 A1 Sep. 30, 2021

Related U.S. Application Data

(60) Provisional application No. 63/000,036, filed on Mar. 26, 2020.

(51) Int. Cl.

| | |
|---|---|
| ***E04F 15/02*** | (2006.01) |
| ***E04B 1/00*** | (2006.01) |
| ***E04B 1/38*** | (2006.01) |

(52) U.S. Cl.

CPC ..... *E04F 15/02044* (2013.01); *E04B 1/003* (2013.01); *E04B 1/388* (2023.08); *E04F 2015/02122* (2013.01); *E04F 2201/05* (2013.01)

(58) Field of Classification Search

CPC .. E04F 2015/02122; E04F 2015/02094; E04F 15/02038; E04F 15/02044; E04F 2201/05; E04F 15/02183; E04B 1/003; E04B 1/40

See application file for complete search history.

(56) References Cited

U.S. PATENT DOCUMENTS

| | | | | |
|---|---|---|---|---|
| 1,714,738 | A * | 5/1929 | Smith | E04F 15/04 52/512 |
| 2,849,715 | A | 9/1958 | Kopf | |
| 2,886,815 | A | 5/1959 | Young | |
| 2,946,060 | A | 7/1960 | Powers | |
| 3,181,662 | A | 5/1965 | Maertzig, Jr. | |
| 3,363,817 | A | 1/1968 | Brack | |
| 3,473,719 | A | 10/1969 | Jephson | |
| 3,633,810 | A | 1/1972 | Krakauer | |
| 3,741,455 | A | 6/1973 | Wandel et al. | |
| 3,923,226 | A | 12/1975 | Maier | |

(Continued)

OTHER PUBLICATIONS

International Search Report and Written Opinion dated Jul. 5, 2021 for International Patent Application No. PCT/US2021/024287.

(Continued)

*Primary Examiner* — Phi D A

(74) *Attorney, Agent, or Firm* — Alix, Yale & Ristas, LLP

(57) ABSTRACT

Disclosed herein is a clip for positioning and securing adjacent grooved planks to a joist. The clip includes a body and a pair of legs. The body extends longitudinally from a front end to a rear end and laterally between opposite lateral edges and defining a hole. Each leg of the pair of legs extends downward from the body at a longitudinal position between the front end and rear end. Each of the front end and the rear end includes a notch in the edge between the opposite lateral edges.

18 Claims, 9 Drawing Sheets

(56) References Cited

U.S. PATENT DOCUMENTS 3,923,227 A 12/1975 Maier
4,339,065 A 7/1982 Haytayan
4,424,929 A 1/1984 Weis
4,485,952 A 12/1984 Weis
4,509,668 A 4/1985 Klaus et al.
4,809,568 A 3/1989 DeCaro
5,025,968 A 6/1991 Nasiatka
5,042,142 A 8/1991 Beach et al.
5,238,167 A 8/1993 Howard et al.
5,378,102 A 1/1995 Mossman
5,502,942 A 4/1996 Gras et al.
5,642,597 A 7/1997 Hendrickson
5,713,709 A * 2/1998 Huang ..... F16B 27/00 206/347
5,803,338 A 9/1998 Singer et al.
5,931,622 A * 8/1999 Gupta ..... F16B 15/08 411/443
6,142,352 A 11/2000 Larson et al.
6,273,316 B1 8/2001 Losada
6,314,699 B1 11/2001 West
6,402,415 B1 6/2002 Eberle, III
6,598,775 B1 7/2003 Chen
6,711,809 B1 3/2004 Fischer et al.
6,761,299 B2 7/2004 Caringella et al.
6,779,697 B2 8/2004 Lin
6,810,633 B2 * 11/2004 Harris, Sr. ..... E04B 5/12 52/489.2
6,871,467 B2 3/2005 Hafner
6,908,022 B2 6/2005 Schmitz
6,932,261 B2 8/2005 Huang
7,052,200 B2 5/2006 Harris
7,111,767 B2 9/2006 Losada
7,287,681 B1 10/2007 Wen
7,516,841 B2 * 4/2009 Uejima ..... F16B 15/08 206/346
7,546,717 B2 6/2009 Juan Puerta
7,644,556 B2 1/2010 Grohman et al.
D612,708 S 3/2010 Fattori et al.
D612,709 S 3/2010 Fattori et al.
D613,593 S 4/2010 King
7,739,807 B2 6/2010 Grant
D625,989 S 10/2010 Mancosh et al.
7,805,902 B2 10/2010 Martel
D629,284 S 12/2010 Loftus
D632,164 S 2/2011 Lappin
7,882,994 B2 2/2011 Francescon
7,908,812 B2 3/2011 Eberle, III
7,908,816 B2 3/2011 Grafenauer et al.
7,984,599 B2 * 7/2011 Snell ..... E01C 5/005 52/586.1
D643,706 S 8/2011 Lappin et al.
D643,707 S 8/2011 Lappin et al.
8,011,153 B2 9/2011 Orchard
8,146,303 B2 * 4/2012 Gibson ..... E04F 15/10 52/177
8,158,044 B2 4/2012 Grohman
8,161,702 B2 4/2012 Eberle, III
8,256,614 B1 9/2012 Wadsworth, Sr.
8,376,203 B2 2/2013 Martel et al.
8,393,125 B2 3/2013 Martel
8,534,526 B2 9/2013 Orchard
8,555,570 B2 10/2013 Martel
8,672,600 B2 * 3/2014 Reznar ..... E04F 15/04 411/457
9,073,295 B2 7/2015 Przybylinski et al.
9,145,673 B1 9/2015 Dantzer
9,181,715 B2 11/2015 Orchard
9,205,536 B2 12/2015 Clark
9,216,847 B2 * 12/2015 Belinda ..... B23B 47/287
9,228,362 B2 1/2016 Eberle, III
9,290,889 B2 3/2016 Choo
D759,471 S * 6/2016 Lee ..... D8/382
9,416,546 B2 8/2016 Claudin
9,555,529 B2 1/2017 Ronconi
9,637,934 B2 5/2017 Wadsworth
D792,757 S 7/2017 Brigham et al.
9,700,931 B2 7/2017 Wadsworth
D795,049 S 8/2017 Brigham et al.
9,850,667 B2 12/2017 Engstrom
9,868,147 B2 1/2018 Wadsworth
9,963,886 B2 5/2018 Mitchell
10,113,306 B2 10/2018 Brigham et al.
10,145,404 B2 * 12/2018 Shadwell ..... F16B 5/121
10,174,496 B2 1/2019 Bertato
10,214,896 B2 2/2019 Tebo
D850,897 S 6/2019 Vandenberg
10,309,099 B2 6/2019 Brigham et al.
10,315,295 B2 6/2019 Vandenberg
D853,829 S 7/2019 Vandenberg
10,378,218 B2 8/2019 Vandenberg
10,407,898 B2 9/2019 Tebo
10,487,460 B2 11/2019 Lee
2002/0059766 A1 5/2002 Gregori
2003/0121226 A1 7/2003 Bolduc
2005/0028473 A1 2/2005 Grohman
2005/0063771 A1 * 3/2005 Harris ..... E04F 15/04 403/294
2006/0059822 A1 3/2006 Guffey
2007/0289249 A1 12/2007 Martel
2010/0083610 A1 4/2010 King
2011/0073824 A1 3/2011 Lappin et al.
2012/0110944 A1 5/2012 Hess
2013/0025228 A1 * 1/2013 Kilgore ..... E04F 15/04 52/578
2014/0174025 A1 6/2014 Kinnunen et al.
2014/0186109 A1 * 7/2014 Wadsworth ..... F16B 5/0072 403/404
2015/0044434 A1 2/2015 Kotiadis et al.
2015/0128520 A1 * 5/2015 Randjelovic ..... E04F 15/10 52/588.1
2015/0354204 A1 12/2015 Kinnunen et al.
2016/0362902 A1 12/2016 Lee et al.
2017/0106513 A1 4/2017 Orchard
2018/0223547 A1 8/2018 Demuth et al.
2018/0238060 A1 * 8/2018 Doupe ..... E04F 15/105
2019/0048578 A1 2/2019 Emerson
2019/0055738 A1 2/2019 Vandenberg
2019/0055974 A1 2/2019 Vandenberg et al.
2019/0071880 A1 3/2019 Demuth et al.
2019/0112802 A1 4/2019 Brigham et al.
2019/0112822 A1 * 4/2019 Busby ..... E04F 15/02044
2019/0136502 A1 5/2019 Bertato
2019/0136546 A1 5/2019 Doupe et al.
2019/0186130 A1 * 6/2019 Penewell ..... E04B 5/026
2019/0211856 A1 7/2019 Getsiv
2019/0271161 A1 9/2019 Culp et al.
2019/0284796 A1 9/2019 Bowker
2019/0309527 A1 10/2019 Bergelin et al.
2019/0360214 A1 11/2019 Vandenberg et al.
2020/0087925 A1 3/2020 Vandenberg et al.
2020/0217084 A1 * 7/2020 Ylikangas ..... E04F 15/02044
2020/0340252 A1 * 10/2020 Carlson ..... E04F 15/02038
2020/0362570 A1 11/2020 Vandenberg et al.

OTHER PUBLICATIONS

"TurboClip Universal Hidden Fastener ¼" Deck Clip for Composite Grooved Boards," retrieved from https://www.ebay.com/itm/TurboClip-Universal-Hidden-Fastener-1-4-Deck-Clip-for-Composite-Grooved-Boards-/352715465168, Jan. 9, 2020.
"TurboClip. Universal Hidden Deck Clip," retrieved Feb. 5, 2019.
"Hidden Fasteners and Composite Saw Blades," retrieved from https://www.trex.com/products/accessory-hardware/, Dec. 12, 2018.
"Discover the hidden beauty of Hidden Deck Fasteners," retrieved from http://www.panamericanscrew.com/products/BROWSE_BRAND/SURE_DRIVE/HIDDEN_DECK_FASTENERS.aspx, Dec. 12, 2018.
"Coyote Clip Installation Instructions," retrieved before Mar. 26, 2020.
"Coyote Clip Hidden Fasteners—Pan American Screw," retrieved from http://www.panamericanscrew.com/products/BROWSE_BRAND/

(56) References Cited

OTHER PUBLICATIONS

SURE_DRIVE/HIDDEN_DECK_FASTENERS/COYOTE_CLIP_
HIDDEN_DECK_FASTENER/, Dec. 12, 2018.

* cited by examiner

DECK CLIP

CROSS-REFERENCE TO RELATED APPLICATION

This application claims priority to U.S. Provisional Application No. 63/000,036, titled Deck Clip, filed on Mar. 26, 2020, the entire content of which is incorporated herein by reference.

BACKGROUND

This disclosure relates generally to deck plank fastener assemblies for securing a deck plank to a joist and for positioning the deck planks. More particularly, this disclosure relates to hidden fastener assemblies for use with deck planks having side grooves.

Numerous hidden deck clips exist and have been proposed which are useful for both securing the deck plank to the underlying joist and which also define a uniform positioning of the adjacent deck plank. It is desirable that such hidden decking clips be adapted for use in a collated series of clips to facilitate automatic driving of the fastener, which may include preset fasteners (screws). It is also highly desirable that the fastener clips be configurable in a compact configuration for packaging, storage and transportation to the installation site.

SUMMARY

Briefly stated, in accordance with one aspect of the disclosure, a clip for positioning and securing adjacent grooved planks to a joist is disclosed. The clip includes a body and a pair of legs. The body extends longitudinally from a front end to a rear end and laterally between opposite lateral edges and defining a hole. Each leg of the pair of legs extends downward from the body at a longitudinal position between the front end and rear end. Each of the front end and the rear end includes a notch in the edge between the opposite lateral edges.

In accordance with another aspect of the disclosure, a clip for positioning and securing adjacent grooved planks to a joist is disclosed. The clip includes a body and a pair of legs. The body extends longitudinally from a front end to a rear end and laterally between opposite lateral edges. Each leg of the pair of legs extends downward from the body at a longitudinal position between the front end and rear end. Each of the legs defines a bottom placement surface and includes an undercut defining a gap between the bottom placement surfaces and the body.

In accordance with another aspect of the disclosure, a clip for positioning and securing adjacent grooved planks to a joist is disclosed. The clip includes a body and a reference spacer. The body extends longitudinally from a front end to a rear end and laterally between opposite lateral edges and defining a hole. The reference spacer extends laterally across the bottom side of the body at a longitudinal position between the front and rear edges. The reference spacer includes an undercut portion at least as wide as the body.

BRIEF DESCRIPTION OF THE DRAWINGS

FIG. 13 shows a trailing plank installed adjacent the leading plank with spacing between;

DETAILED DESCRIPTION

Figure 1:
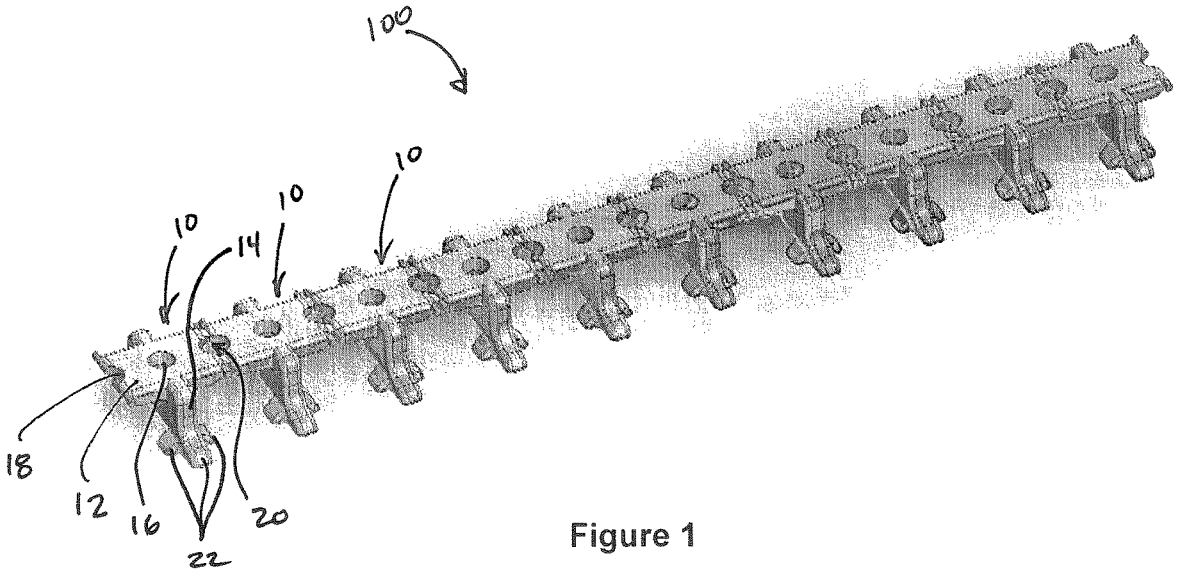
FIG. 1 is a top perspective view of a strip of multiple clips attached to one another.
Figure 2:
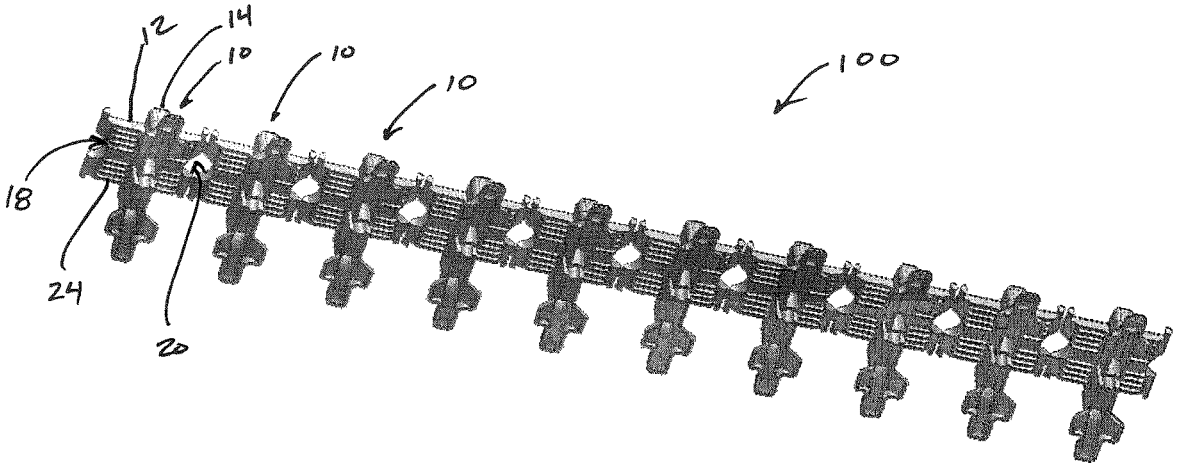
FIG. 2 is a bottom perspective view of the strip of clips of FIG. 1.
Figure 3:
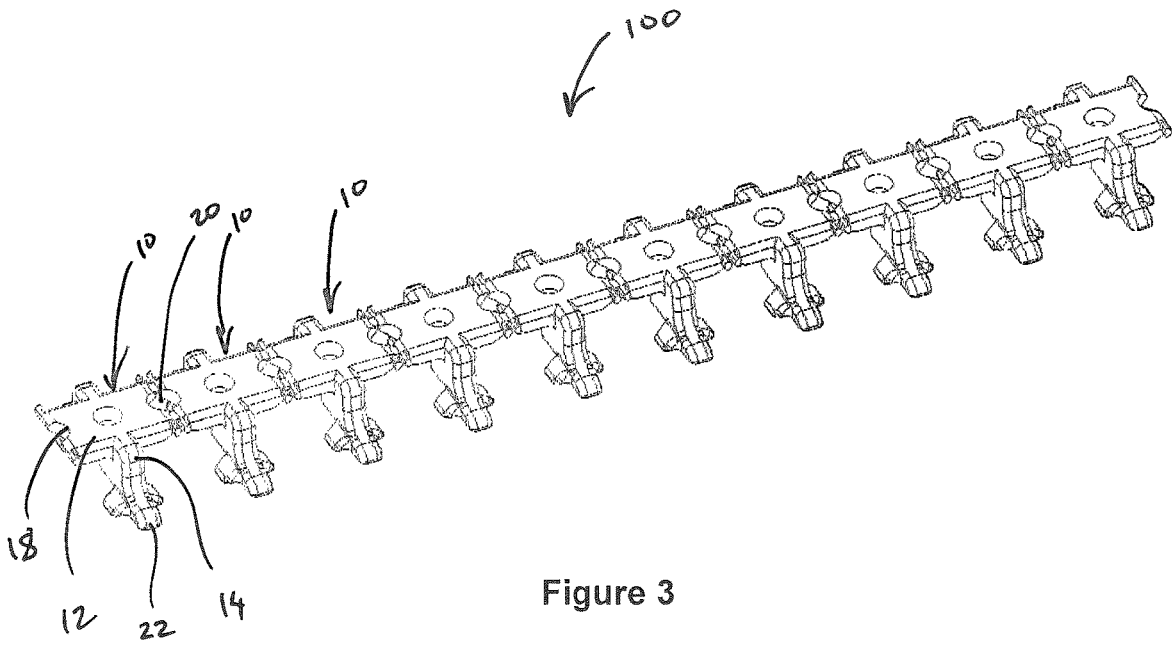
FIG. 3 is another top perspective view of the strip of clips of FIG. 1.
Figure 4:
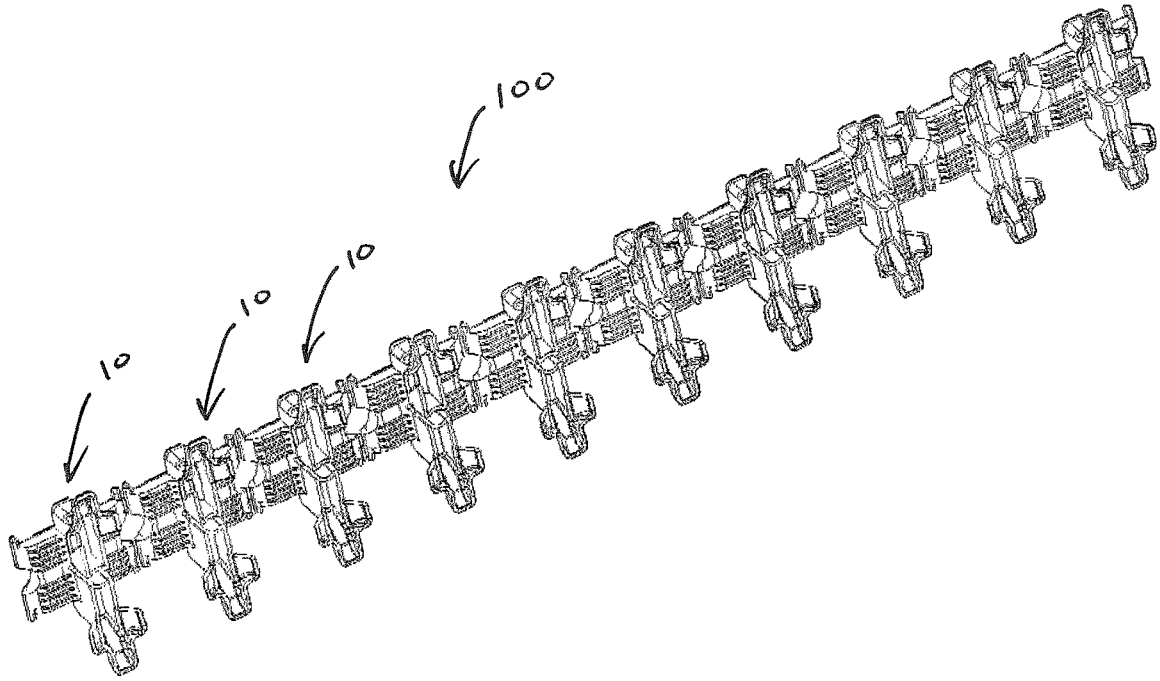
FIG. 4 is another bottom perspective view of the strip of clips of FIG. 1.
Figure 5:
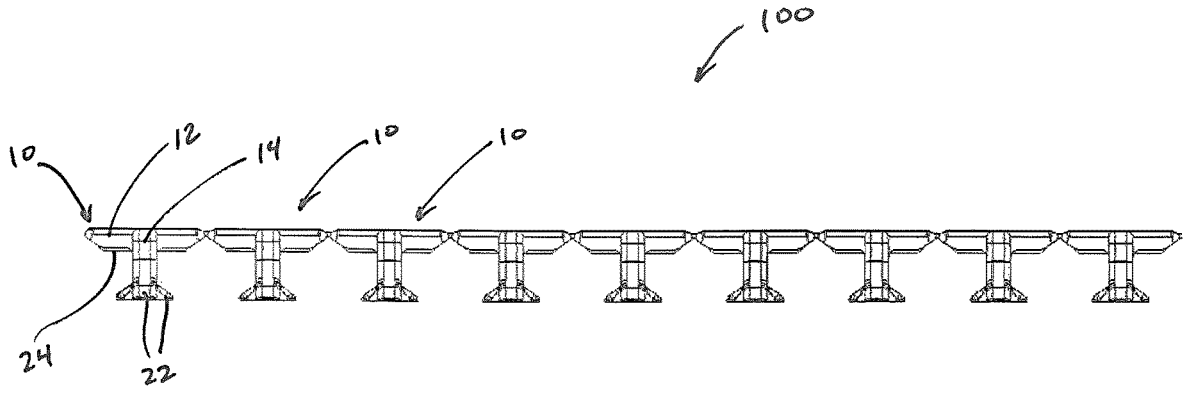
FIG. 5 is a side elevation view of the strip of clips of FIG. 1.
Figure 6:
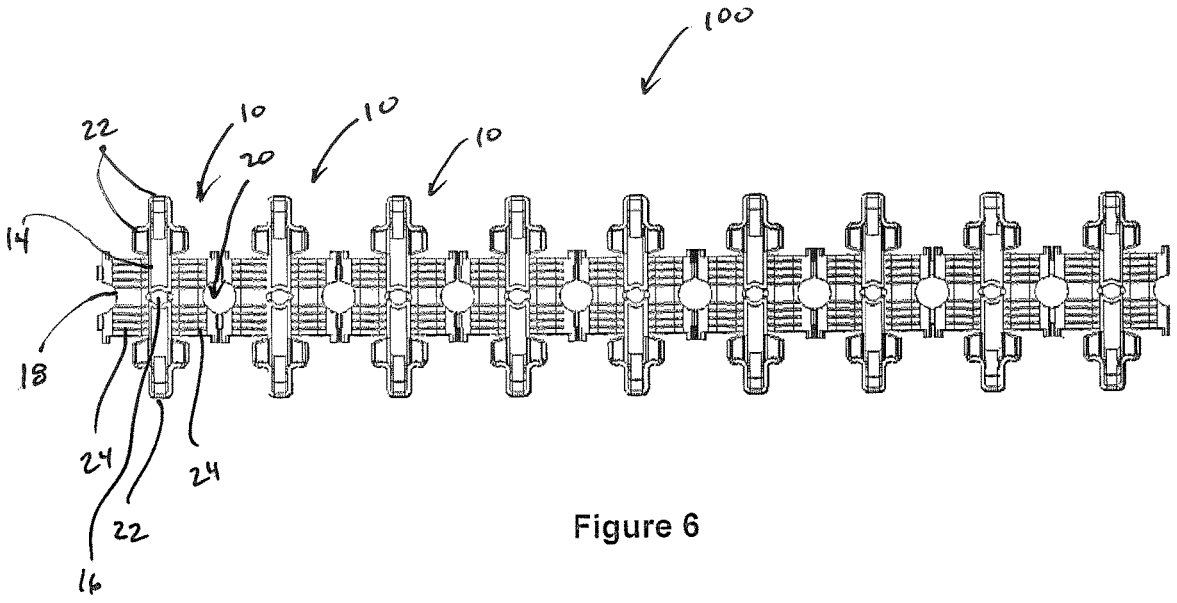
FIG. 6 is a bottom elevation view of the strip of clips of FIG. 1.
Figure 7:
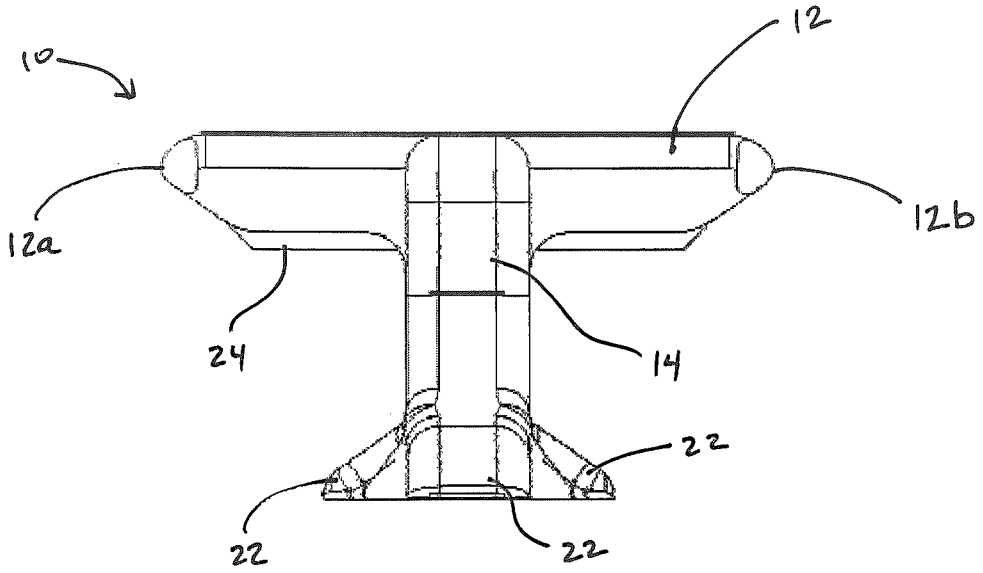
FIG. 7 is a side elevation view of an embodiment of the disclosed deck clip in isolation.

With reference to the drawings wherein like numerals represent like parts throughout the figures, a hidden deck clip for attaching grooved planks P to a support joist J is generally designated by reference numeral 10, and an associated strip of multiple clips joined together in a severable connection is designated by reference numeral 100. Each clip 10 is configured to engage a groove G of the deck plank P and rests on the joist J, and an elongate fastener, such as a screw 34, is driven through the clip 10 and into the joist J at a medial entry location to secure the deck plank to the joist. The clip 10 also acts to provide a preferred spacing between each attached leading deck plank and an adjacent trailing deck plank of the installation (see FIG. 12). In a non-limiting preferred embodiment, the clip 10 is formed from a molded plastic material with high durability and strength.

Each individual clip 10 is an integral molded member symmetric about two orthogonal planes which intersect along a vertical axis through a central opening 16 that extends through an upper base 12. The opening is dimensioned to receive and guide a fastener so that upon proper positioning of the clip with respect to the joist J and the deck plank P, the fastener 34 is driven through the clip into the joist J at a preferred position. The upper portion of the opening 16 may have an outwardly tapered throat to receive the head of the fastener upon driving and ensure a surface-to-surface mating. The lower portion of the opening 16 forms opposed axially extending front and rear slots between opposite lateral legs 14.

As shown, the base 12 extends forwardly between front and rear edges, 12*a* and 12*b*, and laterally between opposite lateral edges. A leg 14 extends laterally outward and downward from each lateral edge, defining a laterally exposed shoulder 26. Each leg 14 includes a substantially flat front surface 14*a* and substantially flat rear surface 14 and a set of feet 22 at its bottom edge.

Figure 8:
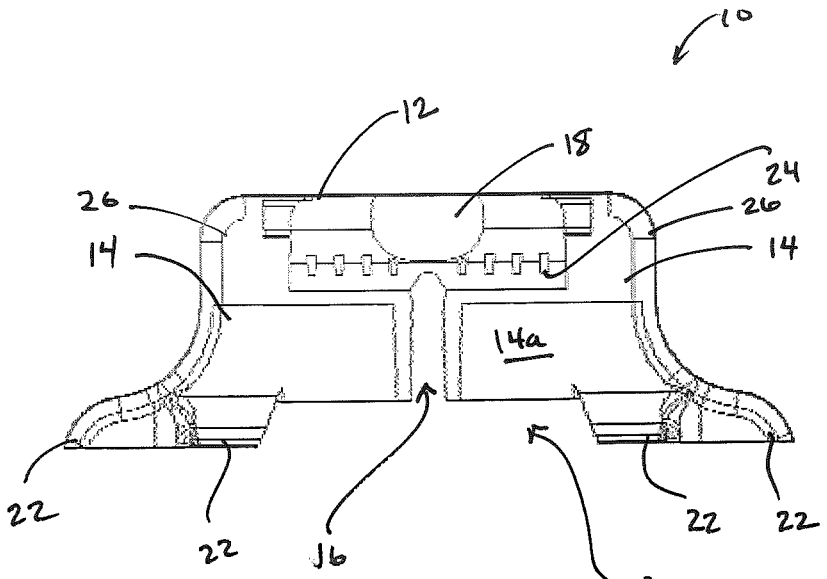
FIG. 8 is a front end elevation view of the clip of FIG. 7.
Figure 9:
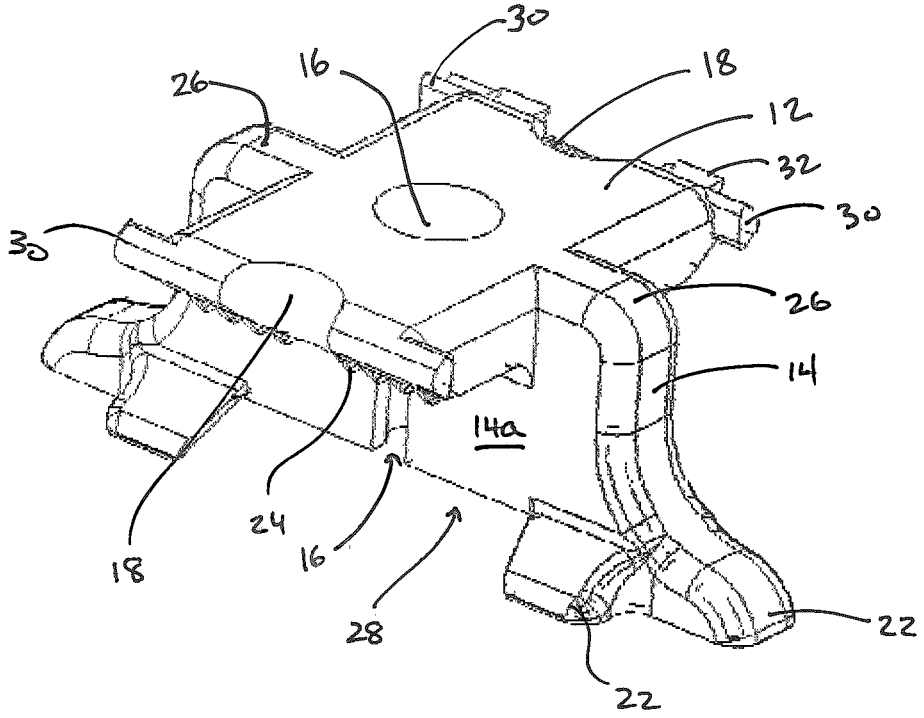
FIG. 9 is a top perspective view of the clip of FIG. 7.
Figure 10:
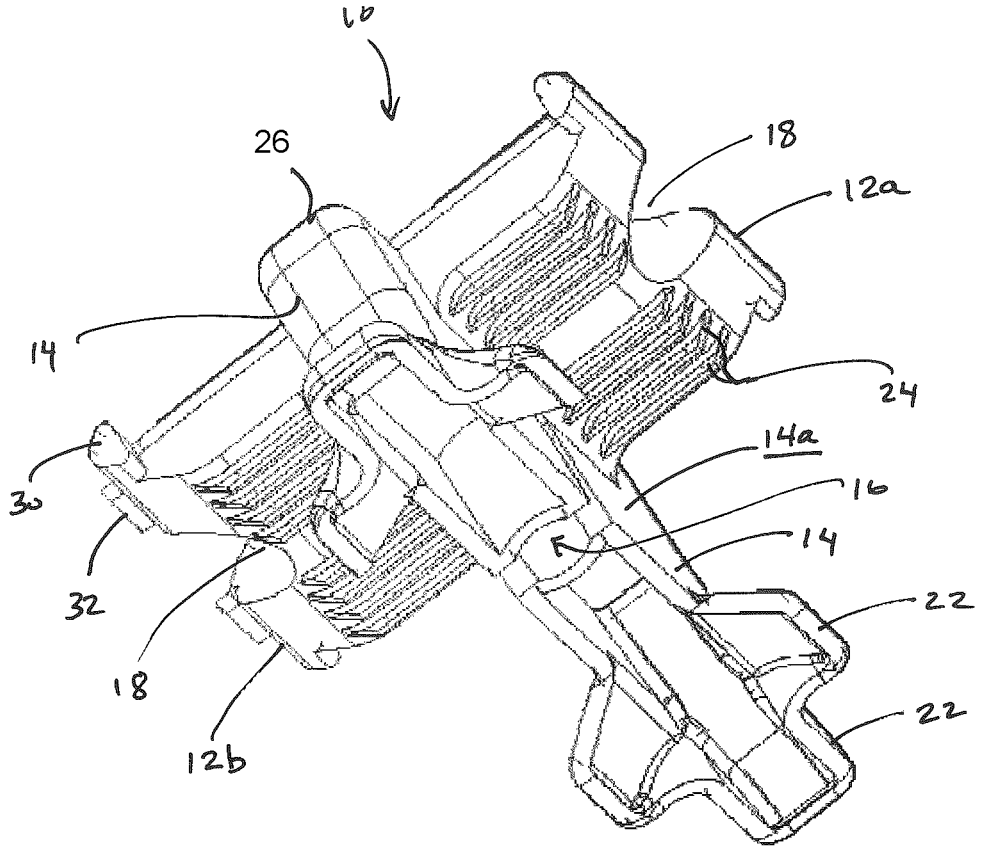
FIG. 10 is a bottom perspective view of the clip of FIG. 7.
Figure 11:
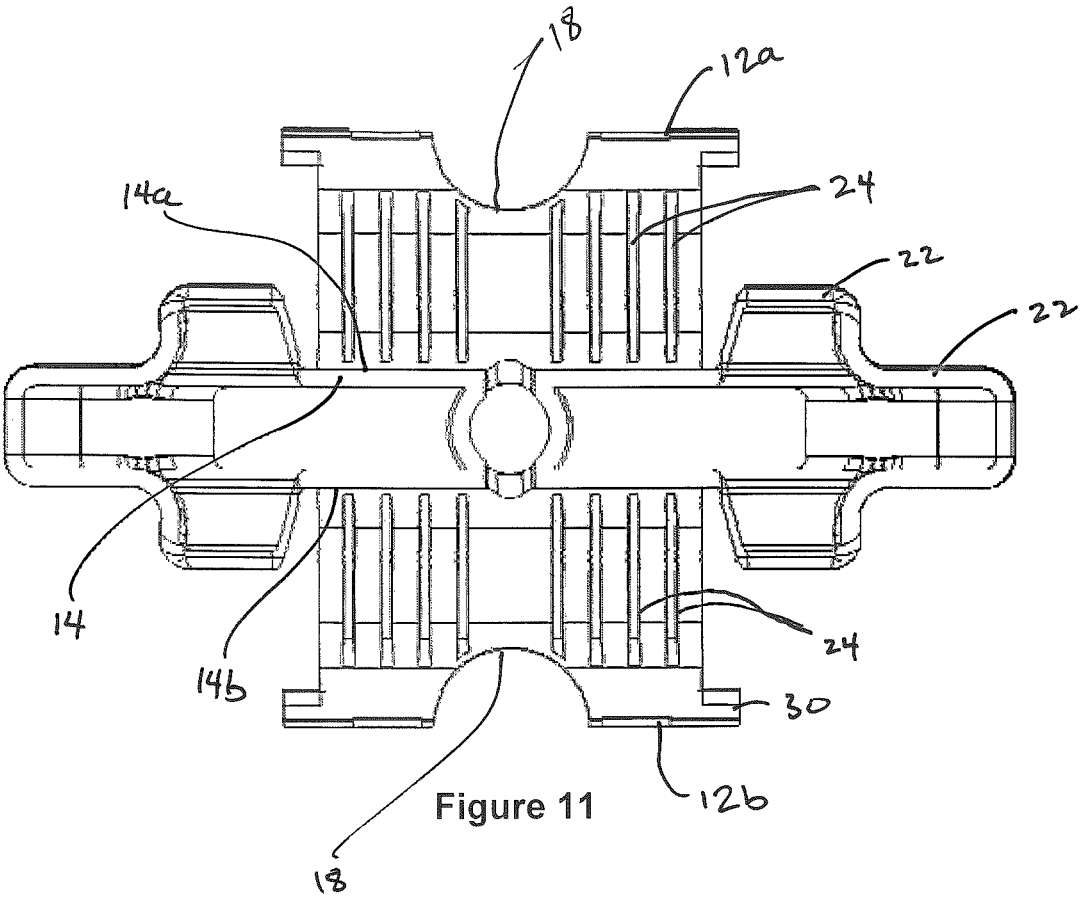
FIG. 11 is a bottom elevation view of the clip of FIG. 7.

The clip body 12 preferably has an upper planar surface a lower surface that carries a series of laterally spaced longitudinally extending ribs 24. The ribs 24 are shown most clearly in FIGS. 8, 10 and 11. As shown, the opposite legs 14 are integral to the body 12 and extend laterally outward from the lateral edges and downward. The body 12 defines a front side that terminates at the front end 12*a* and a substantially identical rear side that terminates at a rear end 12*b*. Each of the front and rear sides of the body acts as a retainer and is contoured for reception into the groove G of a deck plank with the front or rear surface, 14*a* or 14*b*, in abutment with the lower nub of the plank. When installed with a fastener driven through the opening 16, the ribs 24 engage and typically penetrate the outer surface of the plank within the groove to provide rigidity and protect against lateral drift caused by temperature fluctuations and other factors. Additionally, an opposing pair of tabs 30 extends laterally outward from the base 12 at each of the front and rear ends, 12*a* and 12*b*, which assist in alignment and advancement of the clips 10 when installed using a tool with a feeding mechanism. Additionally, the front end 12*a* and rear end 12*b* each includes a semi-circular notch 18. The respective notches 18 in each clip 10 are positioned in lateral alignment with one another such that, when multiple clips 10 are collated in a strip 100, a rear end notch in a leading clip combines with a front end notch in the directly adjacent trailing clip to form a substantially circular hole 20. See FIGS. 1-4 and 6. The depicted preferred embodiment includes semi-circular notches that combine to form a circular opening; however, other geometries can be employed such as rectangular, ovular, or polygonal, provided that the opening is of sufficient size and configuration to pass an elongate fastener through.

Figure 12:
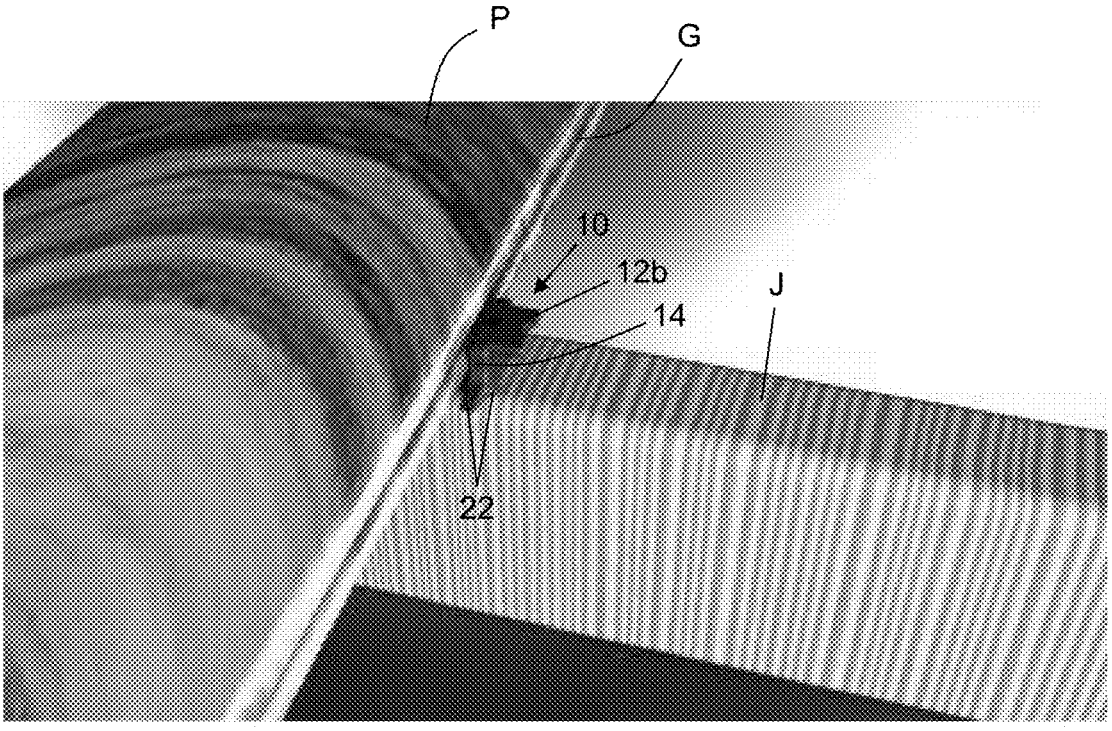
FIG. 12 shows the clip of FIG. 7 during a typical installation attaching a leading deck plank to a support joist.

The longitudinal thickness of the legs 14 defines the spacing defines the proper spacing between adjacent deck planks of the installation. It will be appreciated that the sides are preferably essentially planar and parallel. Each leg 14 includes a set of outwardly extending feet 22 that combine to define a bottom mounting level. As shown in the Figures, each leg 14 carries two opposing longitudinally extending feet (one forward foot and one rearward foot) and one laterally outwardly extending foot that extends substantially perpendicularly to the longitudinal feet. Importantly, the legs 14 are formed with a laterally inner undercut portion that defines a vertical clearance gap 28. During assembly, the clearance gap 28 acts to prevent or minimize inadvertent uplift of the clip 10 as a screw is driven into the joist during installation. While not depicted, an embodiment exists with a solid centrally located laterally extending spacing bar that carries feet 22 on opposite lateral sides (i.e., not two separate legs). As shown in FIG. 12, each of the laterally extending feet 22 hangs laterally outward over a respective opposite edge of the joist J.

The bottom of each foot 22 is coplanar with one another and forms a mounting level that is positioned on top of the support joist J during and after installation. The perpendicular nature of the feet is such that the clip 10, and thus the base 12, is maintained substantially level in all directions during installation.

Figure 13:
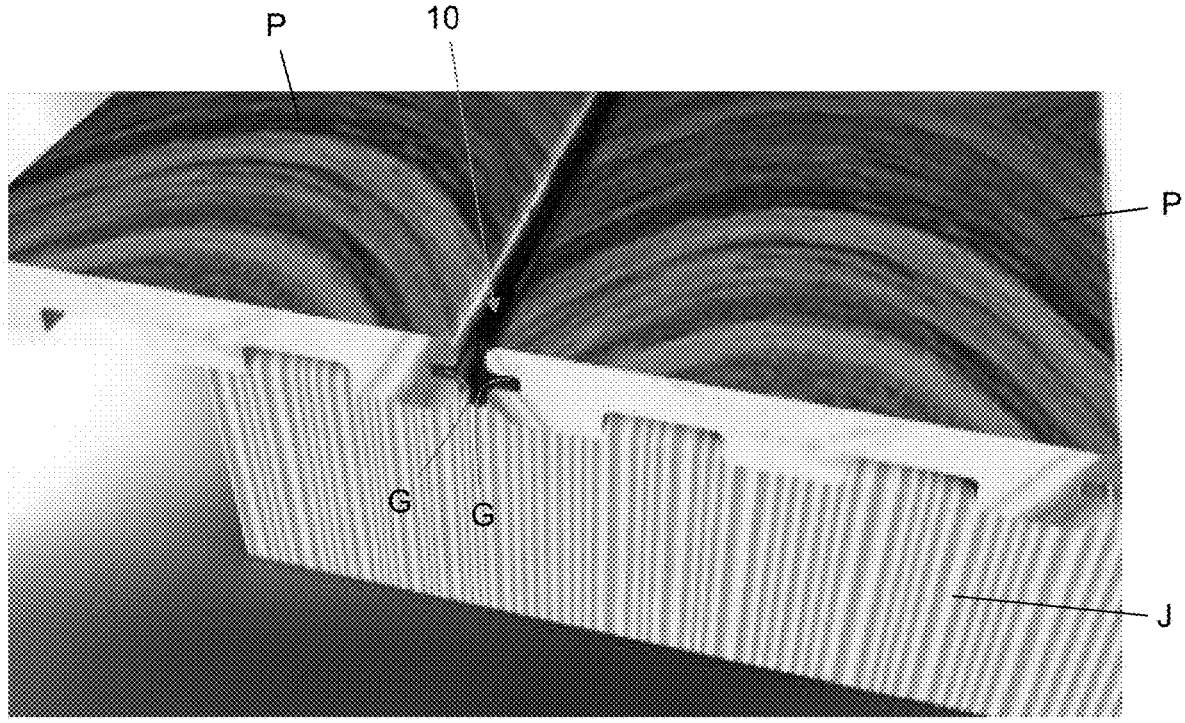

Once one or more clips 10 (typically multiple clips 10) are installed with front side in the trailing groove G of a leading plank, a trailing plank is positioned adjacent the leading plank with the rear side of the clip 10 within the front edge groove G, and the process is repeated to assemble a decking structure. See FIGS. 12 and 13 for reference.

With reference to FIGS. 1-6, multiple clips 10 may be provided in a collated strip 100, with adjacent clips 10 joined together in a severable front-to-rear relationship. A thin strip or strips 32 may be included in the mold of the strip 100 to join each clip together. Preferably the joining strips 32 are thin enough to allow an amount of flexion at the interface between adjacent clips. As shown, the strips are positioned laterally outside of the notches 18 so as not to obstruct the hole 20. The collated strip 100 may be fed via a magazine or similar advancement element or mechanism automatically or by hand, whereby the frontmost clip 10 is maintained at a forward installation position and is severed from the adjacent clip in the strip 100 via the force of driving a fastener through the hole 16. The magazine or advancement unit may include complementary elements, elements and/or surfaces to assist severing the clip when driven. Alternatively, an end clip may be detached by a user and installed as a singular standalone unit.

Figure 14:
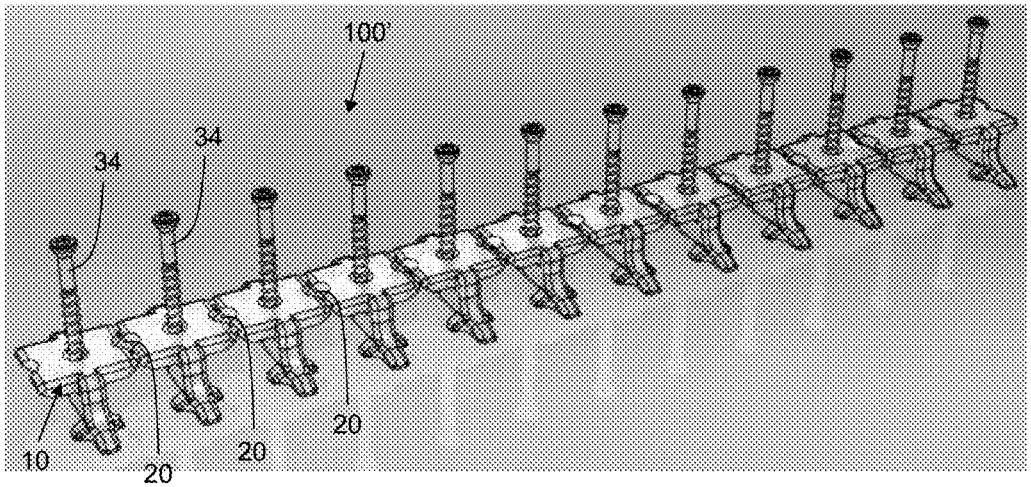
FIG. 14 shows a strip of clips with preset elongate fasteners.
Figure 15:
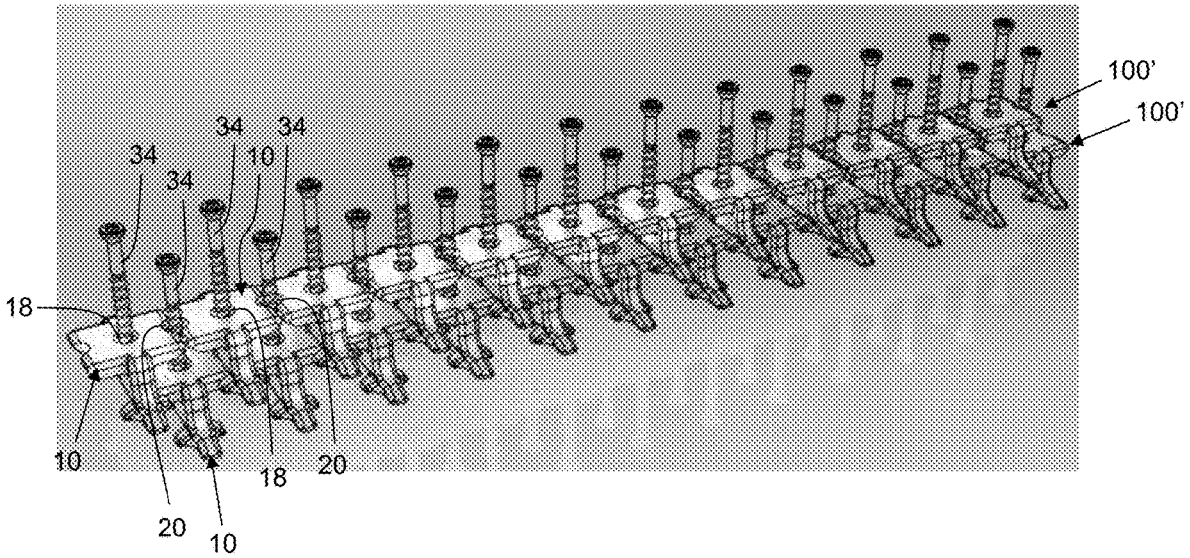
FIG. 15 shows a pair of strips with preset fasteners in a stacked configuration.

As depicted in FIGS. 14 and 15, a strip 100' may be assembled with preset fasteners 34 in each clip hole 16. The intermediate holes 20 formed between each clip 10 allow stacking of strips 100 in a longitudinally offset alignment with the top portions of preset fasteners extending through holes 20 in the strip directly above. FIG. 15 shows a pair of preset collated strips 100' in such a stacked configuration. As can be seen, the clearance gap 28 at the lower end of the clips 10 has a lateral width dimension sufficient to accommodate the base 12 of a clip in the stacked configuration. As such, and as can be seen in the bottom views of FIGS. 6 and 11 and end view of FIG. 8, the feet 22 are positioned entirely outside the lateral extent of the base 12 (i.e., no portion of the base overlies a foot).

Below are provided further descriptions of various non-limiting, exemplary embodiments. The below-described exemplary embodiments may be practiced in conjunction with one or more other aspects or exemplary embodiments. That is, the exemplary embodiments of the invention, such as those described immediately below, may be implemented, practiced or utilized in any combination (e.g., any combination that is suitable, practicable and/or feasible) and are not limited only to those combinations described herein and/or included in the appended claims.

In one exemplary embodiment, a clip for positioning and securing adjacent grooved planks to a joist comprising: a body extending longitudinally from a front end to a rear end and laterally between opposite lateral edges and defining a hole; a pair of legs, each leg extending downward from the body at a longitudinal position between the front end and rear end, wherein each of the front end and the rear end includes a notch in the edge between the opposite lateral edges.

A clip as above, wherein the front notch and rear notch are substantially laterally aligned with one another.

A clip as above, wherein each of the legs defines a bottom placement surface and includes an undercut defining a gap between the bottom placement surfaces and the body.

A clip as above, wherein the body has a lateral width that is less than or equal to a combined lateral width of the undercut of the first and second legs.

A clip as above, wherein the body has a bottom surface with a series of spaced apart ribs.

A clip as above, wherein each leg carries a plurality of feet that define the bottom placement surface.

A clip as above, wherein each leg extends outward from a lateral edge of the body, thereby defining a shoulder.

A clip as above comprising an elongate fastener held within the hole of the body.

A strip of clips, comprising a plurality of clips as above joined together in a front-rear relationship.

A strip of clips as above, comprising an elongate fastener held within the hole of the body of the clips.

A strip of clips as above, wherein the front end of the body of each clip includes a front notch and the rear end of each clip includes a rear notch, wherein the front notch of a trailing clip is aligned with the rear notch of an adjacent leading clip to combine to form a pass through hole.

A strip of clips as above, wherein each clip is severable from an attached clip via force of driving a fastener through the hole of the body.

A clip as above, wherein the clip is mountable to a joist so that support surface rests on the joist and the front end of the body is received in a plank groove, and wherein a fastener driven through the hole in the body and into the joist secures the plank in position.

A clip as above, wherein said clip is manufactured from a rugged plastic material.

In another exemplary embodiment, a clip for positioning and securing adjacent grooved planks to a joist comprising: a body extending longitudinally from a front end to a rear end and laterally between opposite lateral edges; a pair of legs, each leg extending downward from the body at a longitudinal position between the front end and rear end, wherein each of the legs defines a bottom placement surface and includes an undercut defining a gap between the bottom placement surfaces and the body.

A strip of clips, comprising a plurality of clips as above joined together in a front-rear relationship.

A clip as above, wherein the clip is mountable to a joist so that support surface rests on the joist and the front end of the body is received in a plank groove, and wherein a fastener driven through the hole in the body and into the joist secures the plank in position.

In another exemplary embodiment, a clip for positioning and securing adjacent grooved planks to a joist comprising: a body extending longitudinally from a front end to a rear end and laterally between opposite lateral edges and defining a hole; a reference spacer extending laterally across the bottom side of the body at a longitudinal position between the front and rear edges, the reference spacer including an undercut portion at least as wide as the body.

A strip of clips, comprising a plurality of clips as above joined together in a front-rear relationship.

A clip as above, wherein the clip is mountable to a joist so that support surface rests on the joist and the front end of the body is received in a plank groove, and wherein a fastener driven through the hole in the body and into the joist secures the plank in position.

While preferred embodiments of the foregoing have been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

The invention claimed is:

1. A strip of clips for positioning and securing adjacent grooved planks to a joist, comprising a plurality of clips, each clip having a body extending longitudinally from a front edge to a rear edge and laterally between opposite lateral edges and defining a hole longitudinally intermediate the front end and rear end and laterally intermediate the respective lateral edges, and a pair of legs, each leg extending downward from the body at a longitudinal position between the front end and rear end, each of the front edge and rear edge configured to be received within a side groove of a plank, wherein each clip further comprises a first shoulder extending laterally outward from a first of the lateral edges and transitioning downward into a first of the pair of legs, and a second shoulder extending laterally outward from a second of the lateral edges and transitioning downward into a second of the pair of legs, each front edge and each rear edge includes a longitudinally inwardly extending notch in a lateral position between the opposite lateral edges with the notch in the front edge laterally aligned with the notch in the rear end, each rear edge of a leading clip is attached to the front edge of a trailing clip with the respective notches aligned and combining to form a passthrough opening sized and shaped to receive an elongate fastener therethrough, the pair of legs collectively define a bottom placement surface at their respective bottom ends for placement of the clip on a support beam, the pair of legs define a reference spacer therebetween extending laterally along the bottom surface of the body, and the reference spacer includes an undercut that is at least as laterally extensive as the body such that the bottom placement surface is positioned entirely laterally outside the lateral edges of the body.

2. The strip of clips of claim 1, comprising an elongate fastener held within and extending through the hole of the body of at least one clip.

3. The strip of clips of claim 1, wherein each clip is severable from an attached clip via force of driving a fastener through the hole of the body.

4. The strip of clips of claim 1, wherein each of the notches in the attached front edge and rear edge is substantially semi-circular in shape when viewed from a top surface of the body such that they combine to form a substantially circular passthrough opening.

5. A clip for attaching a grooved deck plant to an underlying building beam, comprising an upper body extending longitudinally from a front edge to a rear edge and laterally from a right edge to a left edge, the right and left edges meeting the front and rear edges, the upper body having a hole from a top surface to a bottom surface;

a first shoulder extending laterally outward from the right edge and transitioning downward into a first leg that defines a first placement surface, and an opposite second shoulder extending laterally outward from the left edge and transitioning downward into a second leg that defines a second placement surface, the first leg and second leg defining a reference spacer therebetween extending laterally along the bottom surface of the body and having a substantially flat front surface and substantially flat rear surface; and a slot extending through the reference spacer between the front surface and rear surface, the slot being substantially aligned with the hole, wherein the clip is configured for the front end to be inserted into a side groove in a first decking plank with the bottom placement surface on the building beam and the reference spacer outside of the side groove and then attached to the building beam via driving a fastener through the hole in a direction from the top surface to bottom surface, through the slot and into the underlying building beam.

6. The clip of claim 5, wherein an undercut in the reference spacer extends laterally an entire distance between the first placement surface and the second placement surface.

7. The clip of claim 6, wherein the first placement surface is positioned entirely laterally outside the right edge and the second placement surface is positioned entirely laterally outside the left edge.

8. A clip for attaching a grooved plank to an underlying joist comprising:

a body extending longitudinally from a front end to a rear end and laterally between a right lateral edge and a left lateral edge;

a first shoulder extending laterally outward from the right edge and transitioning downward into a first leg at an intermediate longitudinal position between the front end and rear end, and an opposite second shoulder extending laterally outward from the left edge and transitioning downward into a second leg, the first leg defining a first lower placement surface and second leg defining a second lower placement surface coplanar to the first lower placement surface and combining to form a placement surface of the clip for placement on the underlying joist, wherein the first lower placement surface is entirely laterally outer of the right edge of the body and the second lower placement surface is entirely laterally outer of the left edge, the first leg and second leg define a reference spacer therebetween extending laterally along the bottom surface of the body and having a substantially flat front surface and substantially flat rear surface, the reference spacer defines a slot extending longitudinally therethrough through the front surface and the rear surface, and the slot is aligned with a hole in the body.

9. The clip of claim 8, wherein the body has a bottom surface with a series of spaced apart ribs.

10. The clip of claim 8, wherein each leg carries a foot and the foot of the left leg and foot of the right leg collectively define the bottom placement surface.

11. The clip of claim 8, comprising an elongate fastener held within a hole in the body.

12. The clip of claim 8, wherein said clip is manufactured from a rugged plastic material.

13. The clip of claim 8, comprising a series of projections extending from the bottom surface of the body.

14. The clip of claim 8, comprising a first foot at a bottom of the first leg extending laterally outward therefrom entirely laterally outward of the right edge and a second foot at a bottom of the second leg extending laterally outward therefrom entirely laterally outward of the left edge, the first foot and second foot forming the bottom placement surface.

15. The clip of claim 14, wherein each of the first foot and second foot has a thickness commensurate with a thickness between the front surface and rear surface of the reference spacer.

16. The clip of claim 14, wherein each of the first leg and second leg comprises one or more additional feet extending in the longitudinal direction substantially perpendicular to the first foot and second foot, respectively.

17. The clip of claim 14, wherein the first leg comprises a front foot extending longitudinally and a rear foot extending longitudinally, and the second leg comprises a front foot extending longitudinally and a rear foot extending longitudinally, each of the front feet and each of the rear feet being substantially perpendicular to the first foot and second foot.

18. A clip for attaching a grooved plank to an underlying joist, comprising:

a body extending longitudinally from a front edge to a rear edge and laterally between opposite lateral edges and defining a hole longitudinally intermediate the front end and rear end and laterally intermediate the respective lateral edges, and a pair of legs, each leg extending downward from the body at a longitudinal position between the front end and rear end, each of the front edge and rear edge configured to be received within a side groove of a plank, a first shoulder extending laterally outward from a first of the lateral edges and transitioning downward into a first of the pair of legs, and a second shoulder extending laterally outward from a second of the lateral edges and transitioning downward into a second of the pair of legs, the pair of legs collectively define a bottom placement surface at their respective bottom ends for placement of the clip on a support beam, the pair of legs define a reference spacer therebetween extending laterally along the bottom surface of the body, and the reference spacer includes an undercut that is at least as laterally extensive as the body such that the bottom placement surface is positioned entirely laterally outside the lateral edges of the body.

* * * * *